US005542322A

United States Patent [19]

Knox et al.

[11] Patent Number: 5,542,322

[45] Date of Patent: Aug. 6, 1996

[54] COMPACT FOLDING WRENCH

[75] Inventors: Robert L. Knox, Shiloh; John C. Reddy, Columbus, both of Ga.

[73] Assignee: J. H. Williams Company, Columbus, Ga.

[21] Appl. No.: 376,302

[22] Filed: Jan. 23, 1995

Related U.S. Application Data

[63] Continuation of Ser. No. 112,625, Aug. 27, 1993, abandoned.

[51] Int. Cl.[6] ..... B25B 23/16

[52] U.S. Cl. ..... 81/177.6; 81/177.8

[58] Field of Search ..... 81/177.6, 177.7, 81/177.8, 450

[56] References Cited

U.S. PATENT DOCUMENTS

| | | | |
|---|---|---|---|
| D. 255,979 | 7/1980 | Boursaw . | |
| D. 268,805 | 5/1983 | Kowalewicz . | |
| D. 292,771 | 11/1987 | Kim . | |
| D. 306,127 | 2/1990 | Graham et al. . | |
| 818,761 | 4/1906 | Hanes et al. . | |
| 821,328 | 5/1906 | Bartlett | 87/450 X |
| 854,174 | 5/1907 | Noyer . | |
| 1,006,679 | 10/1911 | Rice | 81/177.6 X |
| 2,097,361 | 10/1937 | Bagley . | |
| 2,628,522 | 2/1953 | Kraft . | |
| 2,764,048 | 9/1956 | Thompson . | |
| 2,891,434 | 6/1959 | Lozensky . | |
| 3,156,143 | 11/1964 | Wolf . | |
| 3,269,228 | 8/1966 | Mack . | |
| 3,356,117 | 12/1967 | Wagner . | |
| 3,839,929 | 10/1974 | Richards | 81/177.7 X |
| 4,611,514 | 9/1986 | Hyde . | |
| 4,748,874 | 6/1988 | Sharp et al. . | |
| 4,791,837 | 12/1988 | Main . | |
| 5,005,448 | 4/1991 | Main . | |
| 5,101,696 | 4/1992 | Neff | 81/450 X |
| 5,201,257 | 4/1993 | Engel | 81/177.6 |
| 5,279,189 | 1/1994 | Marino | 81/177.6 X |

FOREIGN PATENT DOCUMENTS

| | | |
|---|---|---|
| 802015 | 9/1958 | United Kingdom . |

OTHER PUBLICATIONS

Sears Power & Hand Tool 1990, p. 28, Mini Flex–head.

*Primary Examiner*—James G. Smith

*Attorney, Agent, or Firm*—Kilpatrick & Cody; John S. Pratt, Esq.; Scott T. Weingaertner, Esq.

[57] ABSTRACT

A compact, foldable wrench having a head for engaging a threaded fastener to be rotated, and a handle pivotally attached to the head for use in a folded position substantially surrounding the head or an open position projecting radially from the head. The head may contain an opening to receive a fastener head (e.g., may be in the form of a box wrench), or alternatively, it may house a ratchet mechanism adapted to receive a drive socket or other fastener drive. In another embodiment, the head may house a screw driver.

40 Claims, 2 Drawing Sheets

COMPACT FOLDING WRENCH

This is a continuation of application Ser. No. 08/112,625 filed on Aug. 27, 1993 now abandoned.

BACKGROUND OF THE INVENTION

1. Field of the Invention

This invention relates to torque-applying tools, particularly including manually-operated ratchet wrenches and other devices for rotating threaded fasteners.

2. Description of the Related Art

Numerous tools adapted to rotatably drive threaded fasteners and workpieces, such as screws, bolts, nuts and the like, have been developed in the past. These prior tools include common screwdrivers, wrenches, nut drivers, adjustable wrenches, socket wrenches, and ratchet wrenches, to name a few. Particularly important among them are ratchet wrenches, which include a typical square cross-section drive post connected to a ratchet mechanism carried within a housing which may be hemispherically shaped to form a handle, or from which a handle with, typically, a generally cylindrical or rectangular cross-section may project radially. A socket selected from a socket set having various socket openings sized to receive differently dimensioned bolt heads or nuts is then removably secured on the drive post.

Small, hand-held wrenches exist which may be used to tighten or loosen a workpiece. Some such wrenches are even small enough to be carried in a user's pocket. However, due to the relatively small size, the user often cannot apply sufficient torque, since no lever arm or handle is formed on the wrench to get mechanical advantage.

Accordingly, there remains a need for a small, hand-held tool, particularly one that can be carried in a user's pocket, which may be used to quickly tighten or loosen a fastener or other workpiece, but also provide sufficient torque to loosen or tighten a workpiece when the operation requires additional mechanical advantage.

SUMMARY OF THE INVENTION

The present invention provides a small, hand-held tool including a head for engaging a fastener or other workpiece to be rotated, and a handle pivotally attached to the head to pivot between a folded position substantially surrounding the head and an open position projecting from the head and providing a longer moment arm to facilitate application of greater torque. The head may contain an appropriately shaped aperture for receiving a fastener (e.g., it may be a box wrench head), or alternatively, it may house a ratchet mechanism adapted to receive a drive socket or other fastener drivers such as screw drivers.

It is accordingly an object of the present invention to provide a small hand held-tool which may be used to quickly tighten or loosen a fastener, particularly in tight locations where a lengthy handle may be unusable.

It is a further object of the present invention to provide a small, hand-held tool that can be carried in a user's pocket and which can provide sufficient torque to loosen or tighten a fastener when that operation requires additional mechanical advantage.

It is a further object of the present invention to provide a ratchet wrench which can provide sufficient torque to loosen or tighten a threaded fastener when that operation requires additional mechanical advantage.

Further objects and advantages of the present invention will become apparent by reference to the drawings, the following detailed description of the invention, and the claims.

DETAILED DESCRIPTION OF THE DRAWINGS

FIGS. 1–5 illustrate the present invention embodied in a square-drive ratchet wrench, but the present invention is more generally a hand-held tool that rotatably drives a threaded fastener or other workpiece.

Figure 3:
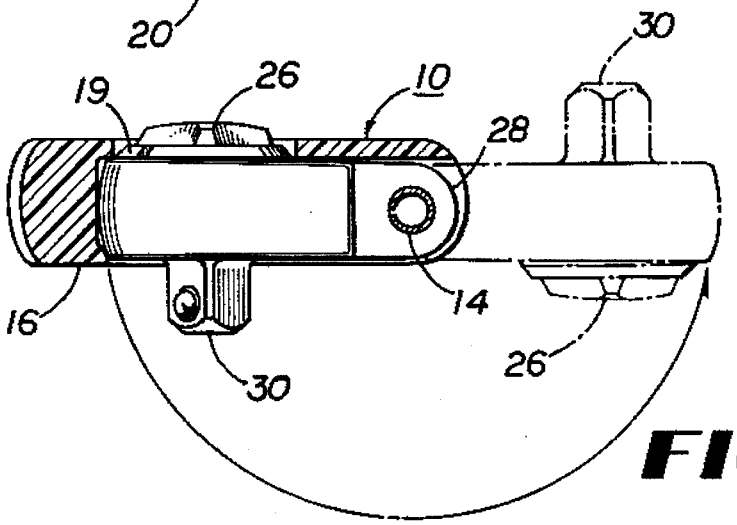
FIG. 3 is a side elevation view showing the wrench head in its folded position in solid lines and in its open position in broken lines and the handle in section along line 3—3 in FIG. 2.
Figure 4:
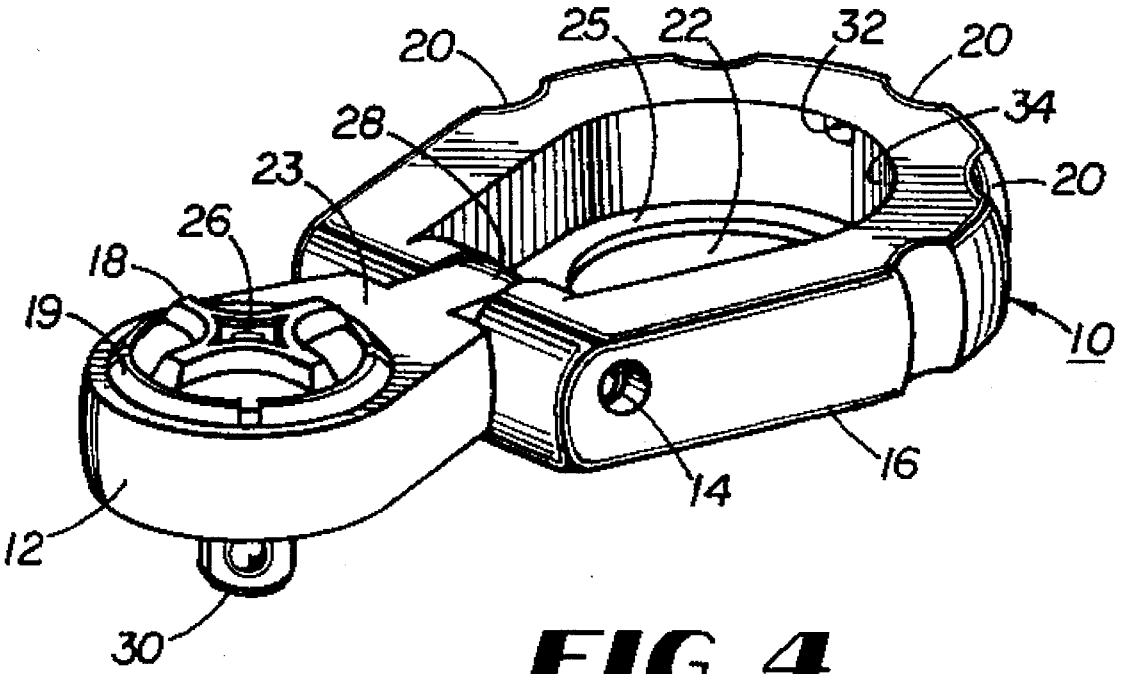
FIG. 4 is a perspective view of the wrench shown in FIG. 1 in the fully unfolded position, showing the top of the wrench head and bottom and side of its handle.
Figure 5:
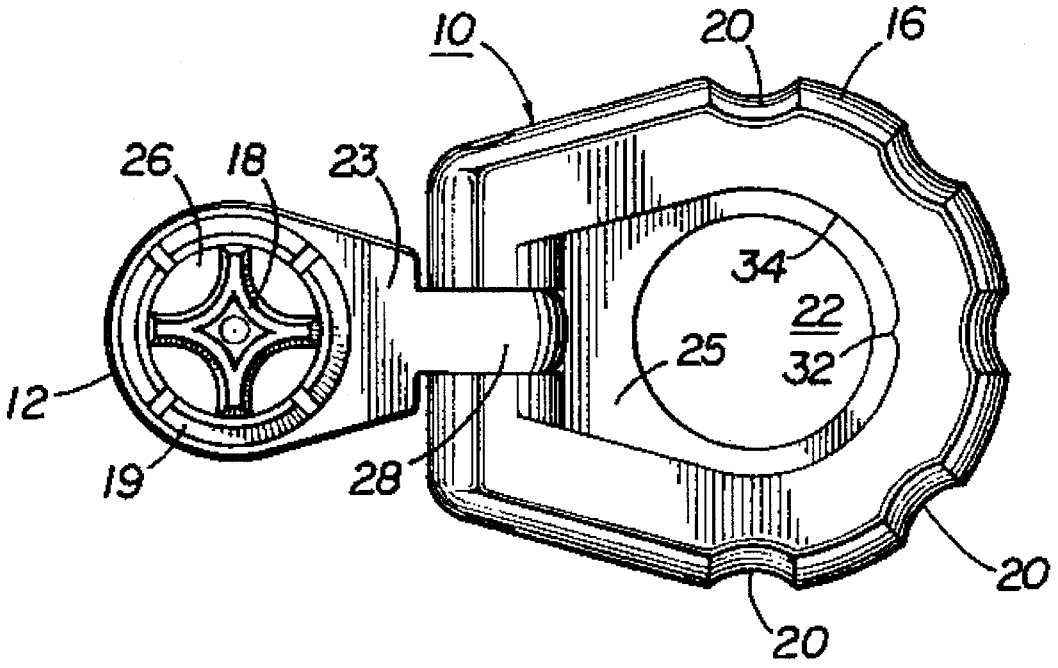
FIG. 5 is a plan view of the wrench shown in FIG. 1 in the fully unfolded position, showing the bottom of the handle and top of the wrench head.
Figure 1:
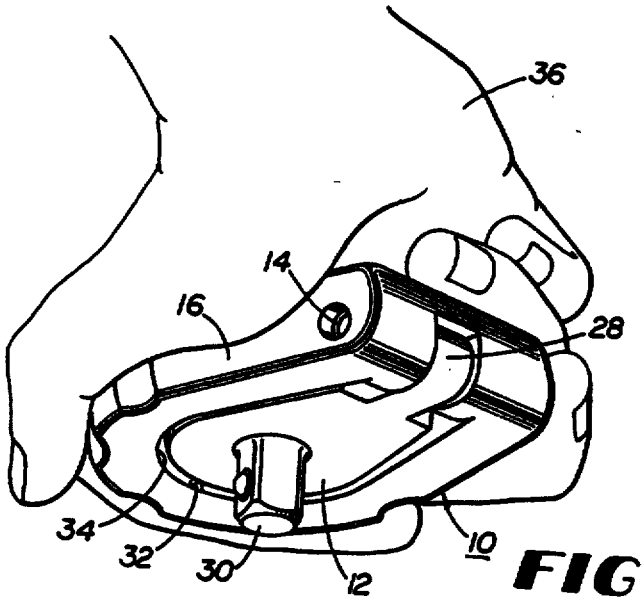
Figure 2:
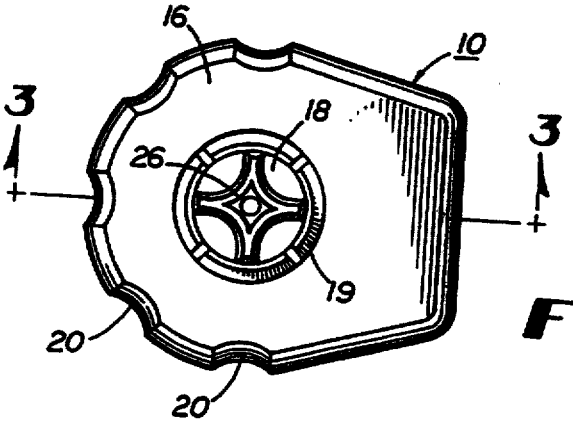
Figure 3:
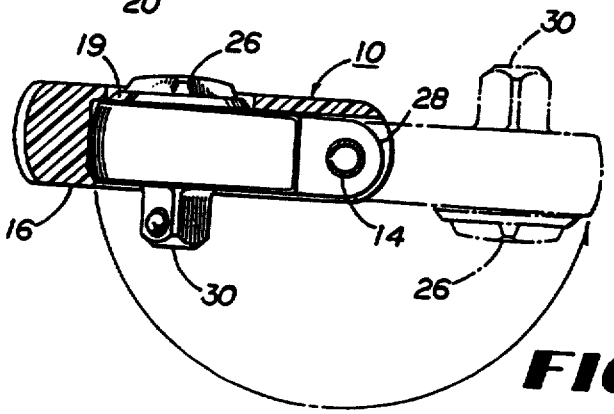
Figure 4:
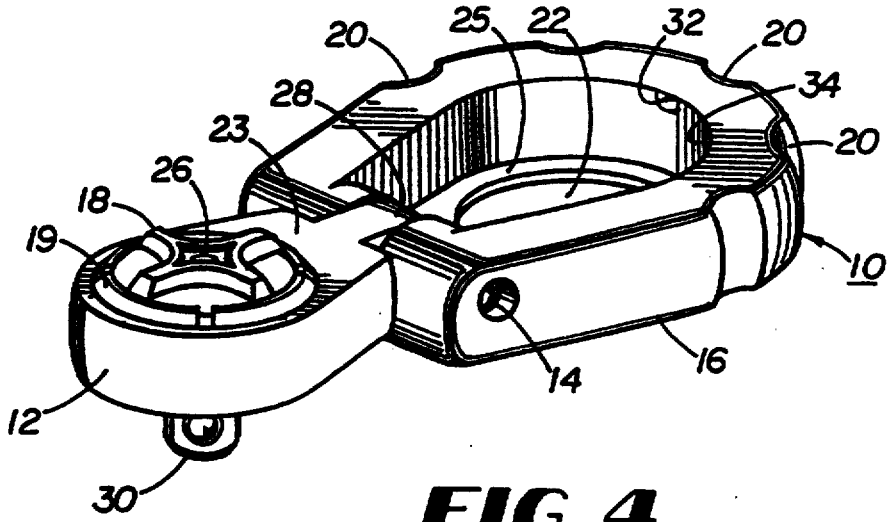
Figure 5:
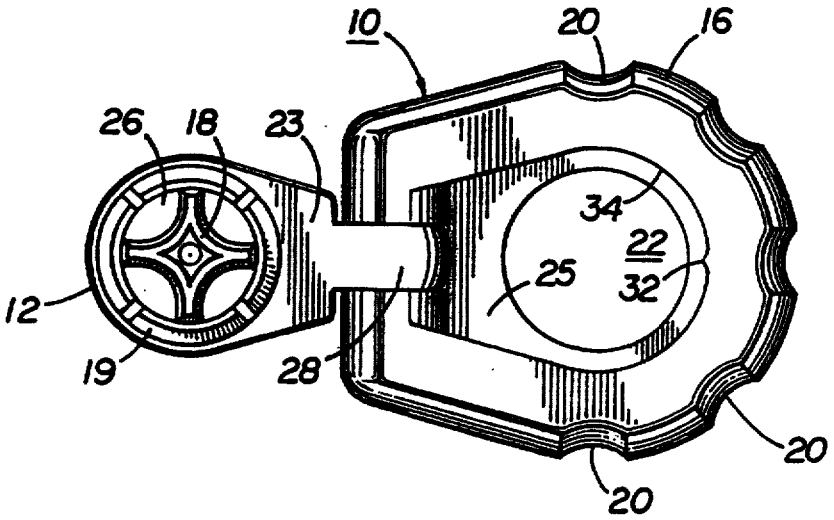

The wrench 10, as may be particularly well-appreciated by reference to FIG. 4, includes a ratchet head 12, connected by a rolled pin pivot 14 to a handle 16. In the illustrated embodiment, the head 12 has a projection or flange 28 on one end through which the pivot 14 runs (FIGS. 1, 3, 4, 5). Pivot 14 permits rotation of head 12 and handle 16 between open and closed positions, as illustrated in FIG. 3. When the wrench 10 is in the fully closed position (FIGS. 1–3), head 12 is at substantially a zero degree angle in relation to the plane of handle 16. When the wrench 10 is in the fully open position (FIGS. 3–5), head 12 is at substantially a 180 degree angle in relation to the plane of handle 16. As will be appreciated by those skilled in the art, head 12, handle 16, and pivot 14 may be made of metal, plastic, and other materials having suitable strength, durability and other required properties. More specifically, head 12, components of the ratchet mechanism contained in it, and pivot 14 may be fabricated of steel, while handle 16 may be injection molded of plastics such as nylon 6,6.

Head 12 may contain a box wrench opening, or a screwdriver of any type, such as the flat-, Phillips-, square-, or Allen-head variety (not shown). Alternatively, square head 12 may house a ratchet mechanism 18, with either a single drive post 30 projecting out of the bottom of head 12 (FIGS. 1, 3, 4), or double drive posts (not shown) projecting out of both the top and bottom of head 12.

Ratchet mechanism 18 may be single or double pawl, and may have a center shift 26. Ratchet mechanism 18 may be held in place with either a threaded keeper 19 (FIGS. 2–5), a spring retainer clip (not shown), or any other suitable retainer mechanism. Naturally, other types of ratchet mechanisms may likewise be employed with the present invention.

Figure 1:
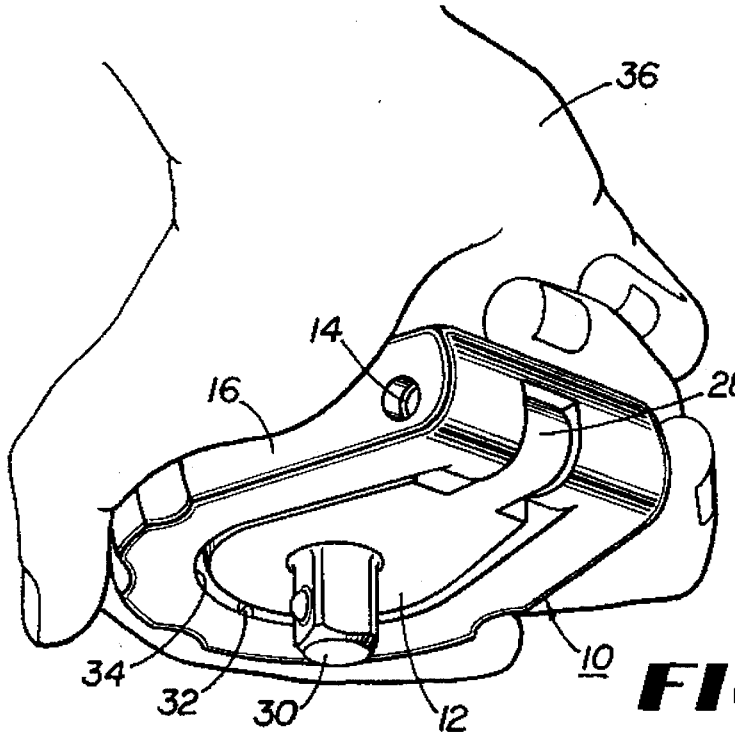
FIG. 1 is a perspective view of the wrench of the present invention in its folded position, nested comfortably in a user's hand.
Figure 2:
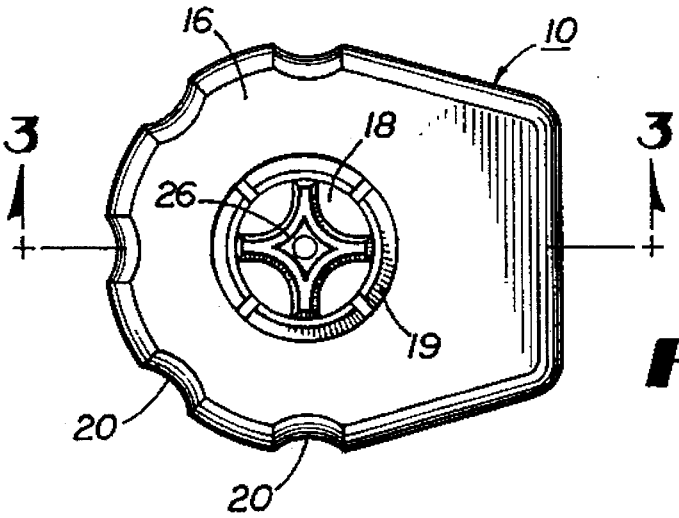
FIG. 2 is a top plan view of the wrench shown in FIG. 1.

Handle 16 substantially surrounds head 12 when wrench 10 is in the fully closed position (FIG. 1, 3). However, in the fully-open position, handle 16 and head 12 are at substantially a 180 degree angle. Among other alternatives, handle 16 may be annulus-, horseshoe-, or rectangular-shaped, and may desirably include scallops 20, or other indentations along its outer circumference to increase the friction between wrench 10 and the user's hand 36, and thus reduce slippage (FIG. 1, 2, 4, 5).

When head 12 is folded into handle 16 the top surface 23 of head 12 seats against a shelf 25 in handle 16 that stops further rotation of head 12 on pivot 14, thereby permitting substantial force to be exerted down along the axis on which post 30 rotates when wrench is used in its folded position. Shelf 25 contains a hole 22 through which center-shift 26 projects so that it can be operated with wrench 10 in its folded position. One or more protrusions 32 along the bottom inside edge 34 of handle 16 capture head 12 when it is folded to keep it in that position during storage, transportation, and the like.

In an alternative embodiment, instead of a pivot 14, the invention includes a means for converting the tool between open and closed positions. This means could include, for example, tongues projecting from flange 28 of head 12 that are received in mating grooves in handle 16 (not shown).

As shown in FIG. 1, the tool may fit comfortably in the hand of a typical user. The tool may be used in the closed position (FIG. 1), or may be used in the open position (FIGS. 3–5) to apply greater torque to a threaded fastener or other workpiece.

As will be readily appreciated by one skilled in the art, numerous modifications of and additions to the wrench 10 described above may be made without departing from the spirit of the present invention as described in the drawings and text above and defined in the following claims.

We claim:

1. A tool for applying torque to a workpiece, comprising:

(a) a head for engaging the workpiece;

(b) a pivot;

(c) a handle connected to the head by the pivot and rotatable between an open position extending radially away from the head and a folded position substantially surrounding the head; and (d) a stop rigidly coupled to the handle for supporting the head.

2. The tool of claim 1, further comprising a ratchet mechanism in the head.

3. The tool of claim 2, wherein the ratchet mechanism further comprises a square drive post.

4. The tool of claim 1, wherein the handle is in the shape of an annulus.

5. The tool of claim 1, wherein the handle is of a size sufficient to fit comfortably in a typical user's hand.

6. The tool of claim 1, wherein the head has a flange on one end through which the pivot runs.

7. The tool of claim 2, wherein the ratchet mechanism is a double pawl, center shift mechanism.

8. The tool of claim 7, wherein the handle contains an aperture permitting switching of the ratchet mechanism while the head is in the folded position, within the plane of the handle.

9. The tool of claim 2, wherein the ratchet mechanism is held in place with a threaded keeper.

10. The tool of claim 1, wherein the pivot permits the pivoting of the head approximately one-hundred and eighty (180) degrees with respect to the handle.

11. The tool of claim 10, wherein the handle stops the pivoting of the head at the folded position and at the open position.

12. The tool of claim 11, wherein the stop comprises a shelf that stops the pivoting of the head at approximately zero (0) degrees with respect to the plane of the handle.

13. The tool of claim 1, in which the stop is integral to the handle.

14. The tool of claim 1, wherein the handle contains indentations on its outer surface to increase the friction with the user's hand and reduce slippage.

15. The tool of claim 13, wherein the handle further includes a means to retain the head in the folded position.

16. The tool of claim 15, wherein the means to retain the head in a folded position includes one or more protrusions along the inside edge of the handle, sad protrusions being in contact with the outer surface of the head when the handle is in the folded position.

17. The tool of claim 13, in which the stop comprises a shelf extending inwardly from the handle for supporting the head in the folded position.

18. The tool of claim 1, in which the handle is generally horseshoe-shaped.

19. The tool of claim 1, in which the handle is generally rectangular.

20. The tool of claim 1, wherein the handle comprises plastic.

21. The tool of claim 20, wherein the plastic comprises nylon 6,6.

22. The tool of claim 12, wherein the handle further comprises a second stop that prevents the pivoting of the head when in the open position past about one-hundred and eighty (180) degrees from the closed position, the second stop being in substantially the same plane as the shelf.

23. Apparatus designed to fit comfortably in a typical user's hand for applying torque to a workpiece comprising:

(a) a head for engaging the workpiece;

(b) a pivot about which the head is movable between an open position and a folded position; and (c) a handle connected to the pivot comprising;

(i) an inner perimeter substantially surrounding the head when the head is in the folded position;

(ii) rigid support means, against which the head abuts when the head is in the folded position, for allowing substantial force to be exerted upon the head when it engages the workpiece while in the folded position; and (iii) restraining means for preventing the head from pivoting about the pivot beyond the open position.

24. The apparatus of claim 23, further comprising a screwdriver attached to the head.

25. The apparatus of claim 23, wherein the support means comprises a shelf extending inwardly from the inner perimeter.

26. The apparatus of claim 23, wherein the restraining means comprises a flange that prevents the head from pivoting beyond the open position, wherein the head is stopped at one-hundred and eighty (180) degrees of rotation from the folded position.

27. A pocket-sized ratchet designed to fit comfortably in a typical user's hand for applying torque to a workpiece, said ratchet comprising:

(a) a ratchet head, having an outer perimeter and a shift mechanism and a drive means for engaging the workpiece;

(b) a pivot about which the ratchet head moves between an open position and a folded position;

(c) a handle pivotably coupled to the head by the pivot, comprising:

(i) an inner perimeter substantially surrounding the outer perimeter of the ratchet head when the head is in the folded position, without obstructing engagement between the ratchet head and the workpiece or preventing access to and operation of the shift mechanism with substantially equal facility as in the open position;

(ii) a rigid shelf against which the outer perimeter of the ratchet head abuts when the head is in the folded position so that the ratchet head does not move about the pivot when substantial force is exerted upon it during use while in the folded position; and (iii) means for preventing the ratchet head from pivoting more than approximately one-hundred and eighty (180) degrees.

28. A tool for applying torque to a workpiece, said tool comprising:

(a) a head for engaging the workpiece;

(b) a pivot; and (c) a handle connected to the head by the pivot, the handle being pivotable between an open position and folded position, the handle extending radially away from the head in the open position, the handle substantially encircling the head in the folded position without obstructing engagement between the head and the workpiece or preventing operation of the head, the handle comprising a rigid stop for preventing rotation of the head beyond the folded position.

29. A compact folding ratchet comprising:

a ratchet head and a handle, the handle being pivotally mounted to the head, at a location spaced away from the axis of rotation of the ratchet, the pivotal mount being for movement of the handle between a folded position and an open position, the head and handle being shaped so that the handle nests over the head in the folded position, the handle comprising a rigid stop for supporting the head, the ratchet being fully operable in both the folded and open positions.

30. The ratchet as claimed in claim 29, further comprising an engagement means between the outside surface of the head and the inside surface of the handle, said engagement means being for maintaining the head in the folded position as desired when the handle is held by the user.

31. The ratchet claimed in claim 30 wherein the engagement means is a protrusion on the inside surface of the handle.

32. The ratchet claimed in claim 29 having limiting means for preventing pivoting movement of the handle in excess of approximately 180 degrees with respect to the head, whereby the handle is in the folded position at zero degrees and is in the open position at approximately 180 degrees.

33. The ratchet claimed in claim 32 wherein the stop is an inwardly extending shelf in the handle, and wherein the shelf contacts an outside surface of the head at the zero degree position.

34. The ratchet claimed in claim 32, wherein the head includes a flange and the handle includes a flange surface, and the limiting means at the 180 degree position is the interference between the flange and the flange surface.

35. The ratchet claimed in claim 29 wherein the head has a drive member on one side and a shift lever on the other side, and wherein the handle is substantially annular, whereby the drive member and the shift lever are both fully accessible in the folded position.

36. The ratchet claimed in claim 29 wherein the portion of the head located distally from the pivot is substantially round, and the portion of the head adjacent the pivot is a flange extending radially outwardly, and the handle is cup shaped in its main body whereby the handle has a main aperture and a cavity, and the handle has a second aperture on the side opposite the main aperture, the second aperture being smaller than the main aperture, and the head fits within the cavity in the folded position, the head having a driving member on one side, the driving member protruding through the main aperture when the handle is in the folded position, the head having a shift lever on the side opposite the drive member, the shift lever being accessible through the second aperture when the handle is in the folded position.

37. In a ratchet wrench having a ratchet head, a square drive in the ratchet head, and a handle, the handle being pivotally attached to the head, the pivot location being remote from the rotational axis of the ratchet, the improvement comprising: the handle being substantially cup shaped such that the handle forms a cavity and the handle has a main opening, the cavity within the handle having a configuration and being of a rigidity such that the head substantially fits through the main opening and within the handle when the head is pivoted to one extreme position and is supported by the handle in that position, and the handle extending radially outwardly from the head when the head is pivoted to a second position.

38. The improvement claimed in claim 37 wherein the handle has a second opening, the second opening being on the side of the handle opposite from the main opening so as to form a hole in the cup.

39. A tool for applying torque to a workpiece, the tool comprising a head for engaging the workpiece, the head being pivotally attached to a handle and rotatable between an open position outside of the handle in which position the head extends from the handle at an angle of no more than approximately one-hundred and eighty (180) degrees and a folded position within the handle, the head comprising a rigid stop for supporting the head in the folded position.

40. A tool for applying torque to a workpiece, said tool comprising a generally horseshoe-shaped handle that is of a size that fits comfortably in a typical user's hand and a ratchet head for engaging a workpiece, said head being pivotally attached to the handle to pivot between an open position extending radially outward from the handle and a folded position in which the handle substantially surrounds the ratchet head, the handle comprising a rigid stop for supporting the head in the folded position.

* * * * *

UNITED STATES PATENT AND TRADEMARK OFFICE

CERTIFICATE OF CORRECTION

PATENT NO. : 5,542,322
DATED : August 6, 1996
INVENTOR(S) : Robert L. Knox et al.

It is certified that error appears in the above-identified patent and that said Letters Patent is hereby corrected as shown below:

The title page should be deleted to appear as per attached.

The Drawing sheet consisting of Figs, 1-5 should be deleted to appear as per attached.

Signed and Sealed this

Twenty-fifth Day of February, 1997

*Attest:*

Bruce Lehman

BRUCE LEHMAN

*Attesting Officer*

*Commissioner of Patents and Trademarks*

United States Patent [19]

Knox et al.

[11] Patent Number: 5,542,322

[45] Date of Patent: Aug. 6, 1996

[54] COMPACT FOLDING WRENCH

[75] Inventors: Robert L. Knox, Shiloh; John C. Reddy, Columbus, both of Ga.

[73] Assignee: J. H. Williams Company, Columbus, Ga.

[21] Appl. No.: 376,302

[22] Filed: Jan. 23, 1995

Related U.S. Application Data

[63] Continuation of Ser. No. 112,625, Aug. 27, 1993, abandoned.

[51] Int. Cl.[6] ..... B25B 23/16

[52] U.S. Cl. ..... 81/177.6; 81/177.8

[58] Field of Search ..... 81/177.6, 177.7, 81/177.8, 450

[56] References Cited

U.S. PATENT DOCUMENTS

| | | | |
|---|---|---|---|
| D. 255,979 | 7/1980 | Boursaw . | |
| D. 268,805 | 5/1983 | Kowalewicz . | |
| D. 292,771 | 11/1987 | Kim . | |
| D. 306,127 | 2/1990 | Graham et al. . | |
| 818,761 | 4/1906 | Hanes et al. . | |
| 821,328 | 5/1906 | Bartlett | 87/450 X |
| 854,174 | 5/1907 | Noyer . | |
| 1,006,679 | 10/1911 | Rice | 81/177.6 X |
| 2,097,361 | 10/1937 | Bagley . | |
| 2,628,522 | 2/1953 | Kraft . | |
| 2,764,048 | 9/1956 | Thompson . | |
| 2,891,434 | 6/1959 | Lozensky . | |
| 3,156,143 | 11/1964 | Wolf . | |
| 3,269,228 | 8/1966 | Mack . | |
| 3,356,117 | 12/1967 | Wagner . | |
| 3,839,929 | 10/1974 | Richards | 81/177.7 X |
| 4,611,514 | 9/1986 | Hyde . | |
| 4,748,874 | 6/1988 | Sharp et al. . | |
| 4,791,837 | 12/1988 | Main . | |
| 5,005,448 | 4/1991 | Main . | |
| 5,101,696 | 4/1992 | Neff | 81/450 X |
| 5,201,257 | 4/1993 | Engel | 81/177.6 |
| 5,279,189 | 1/1994 | Marino | 81/177.6 X |

FOREIGN PATENT DOCUMENTS

| | | |
|---|---|---|
| 802015 | 9/1958 | United Kingdom . |

OTHER PUBLICATIONS

Sears Power & Hand Tool 1990, p. 28, Mini Flex-head.

*Primary Examiner*—James G. Smith
*Attorney, Agent, or Firm*—Kilpatrick & Cody; John S. Pratt, Esq.; Scott T. Weingaertner, Esq.

[57] ABSTRACT

A compact, foldable wrench having a head for engaging a threaded fastener to be rotated, and a handle pivotally attached to the head for use in a folded position substantially surrounding the head or an open position projecting radially from the head. The head may contain an opening to receive a fastener head (e.g., may be in the form of a box wrench), or alternatively, it may house a ratchet mechanism adapted to receive a drive socket or other fastener drive. In another embodiment, the head may house a screw driver.

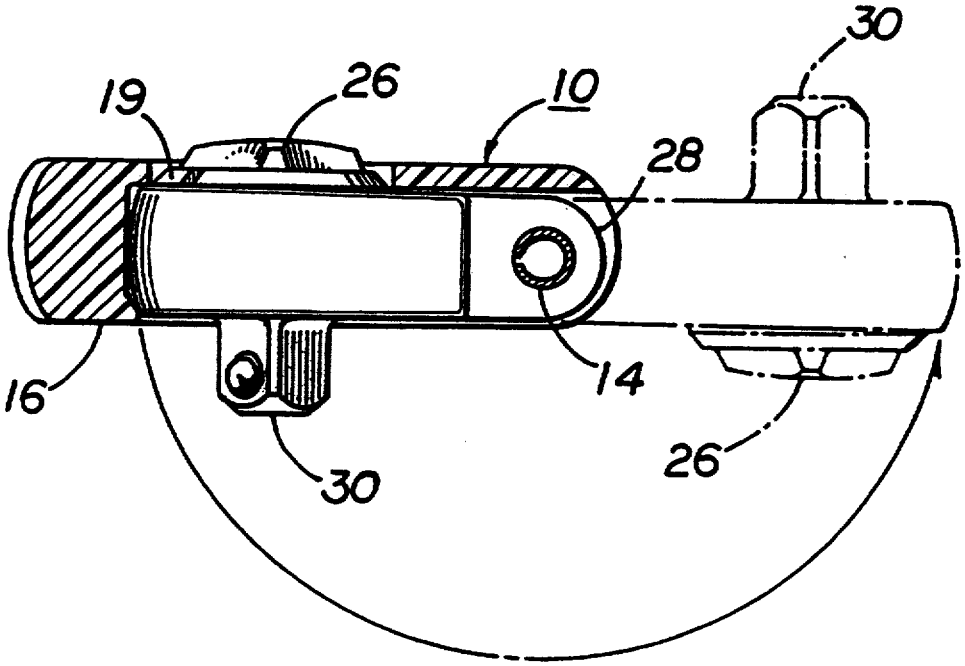

40 Claims, 2 Drawing Sheets